US008122922B2

(12) United States Patent
Baker

(10) Patent No.: US 8,122,922 B2
(45) Date of Patent: Feb. 28, 2012

(54) CLOSURE AND DISPENSING SYSTEM

(76) Inventor: Raymond J. Baker, Moonee Ponds (AU)

( * ) Notice: Subject to any disclaimer, the term of this patent is extended or adjusted under 35 U.S.C. 154(b) by 367 days.

(21) Appl. No.: 12/514,639

(22) PCT Filed: Nov. 13, 2007

(86) PCT No.: PCT/AU2007/001742

§ 371 (c)(1),
(2), (4) Date: May 13, 2009

(87) PCT Pub. No.: WO2008/058326

PCT Pub. Date: May 22, 2008

(65) Prior Publication Data

US 2010/0024914 A1 Feb. 4, 2010

(30) Foreign Application Priority Data

Nov. 13, 2006 (AU) ..... 2006906330

(51) Int. Cl.
*B65B 1/04* (2006.01)

(52) U.S. Cl. ..... 141/326; 141/27; 141/329; 215/247; 215/311

(58) Field of Classification Search ..... 141/23, 141/25–27, 301, 319, 325, 326, 329, 346, 141/347; 215/247, 267, 311; 604/407
See application file for complete search history.

(56) References Cited

U.S. PATENT DOCUMENTS

| | | | | | |
|---|---|---|---|---|---|
| 2,804,224 | A | | 8/1957 | Barton | |
| 4,230,112 | A | * | 10/1980 | Smith | 604/403 |
| 4,244,478 | A | * | 1/1981 | Handman | 215/249 |
| 4,573,506 | A | * | 3/1986 | Paoletti | 141/98 |
| 5,433,330 | A | * | 7/1995 | Yatsko et al. | 215/247 |
| RE35,167 | E | * | 3/1996 | Mouchawar et al. | 215/307 |
| 5,598,939 | A | * | 2/1997 | Watson et al. | 215/307 |
| 5,620,434 | A | | 4/1997 | Brony | |
| 5,871,110 | A | * | 2/1999 | Grimard et al. | 215/249 |
| 5,971,181 | A | * | 10/1999 | Niedospial et al. | 215/247 |
| 6,499,617 | B1 | | 12/2002 | Niedospial, Jr. et al. | |
| 6,666,852 | B2 | | 12/2003 | Niedospial, Jr. | |
| 6,726,060 | B1 | | 4/2004 | Ragusa et al. | |
| 2005/0159724 | A1 | | 7/2005 | Enerson | |
| 2009/0178725 | A1 | * | 7/2009 | Sonnier | 141/27 |

FOREIGN PATENT DOCUMENTS

| | | | |
|---|---|---|---|
| BE | 486224 | A | 12/1948 |
| DE | 4340910 | C1 | 1/1995 |
| DE | 10336523 | A1 | 2/2005 |
| DE | 102004034899 | A1 | 5/2005 |
| JP | 2001187110 | A | 7/2001 |
| WO | 9517873 | A1 | 7/1995 |
| WO | 02064077 | A1 | 8/2002 |

OTHER PUBLICATIONS

Leijten, Rene; Application No. EP 07 81 5545; Extended European Search Report; Sep. 3, 2010.

Leijten, Rene; Application No. EP 07 81 5545; European Search Report; Aug. 23, 2011.

* cited by examiner

*Primary Examiner* — Timothy L Maust

(74) *Attorney, Agent, or Firm* — Stevens & Showalter LLP

(57) ABSTRACT

A closure (12) for a container (14) adapted to store fluid (16) to be dispensed, said closure comprising a body (17) having an outer surface (23) communicating with the exterior of said container and an inner surface (27) embedded within said body wherein said outer surface includes a cavity (26) adapted to sealably receive a dispensing device (32).

17 Claims, 3 Drawing Sheets

38
32
26
12
18
17
21
28
29
33
36
34
37
39
19
15
16
14

15
14
55
28
26
21
12
59
56
57
58

44
52
12
52
37

52
17
44
16
14
15
51
41
52
12
32

CLOSURE AND DISPENSING SYSTEM

CROSS-REFERENCE TO RELATED APPLICATIONS

The present application claims priority from Australian Provisional Patent Application No 2006906330 filed on 13 Nov. 2006, the content of which is incorporated herein by reference.

INTRODUCTION TO THE INVENTION

This invention relates to a closure for a fluid container which facilitates dispensing the fluid. The invention also relates to a dispensing system for dispensing a fluid stored in a container.

The invention is particularly suitable for dispensing liquids, slurries, lotions, creams and other similar substances. The system may also be adapted to dispense gases, if required. However, for ease of understanding, the invention will be described herein in relation to the dispensing of a liquid substance stored in a container.

BACKGROUND TO THE INVENTION

Many liquid substances, including pharmaceutical and veterinary preparations, substances for medical use, chemical reagents and numerous other substances need to be dispensed from a storage container, particularly sterile storage containers, in such a way that the remaining contents are not contaminated. Any system used for dispensing, for example, sterile substances, must be designed such as to ensure the substance being dispensed remains sterile, as well as minimising the possibility of contamination of any sterile substance remaining in the container. In many instances, it is necessary to dispense only a portion of the quantity of material stored in a container in a way that the container is resealed for subsequent dispensing of additional, uncontaminated substance.

It has been common practice to dispense liquid substances from sterile containers by extracting the substance using a syringe having a needle which is caused to pass through a resilient stopper on the container whereby the contents may be extracted through the needle into the syringe. The syringe may then be used to dispense the substance, either by injecting the substance into a patient, or an animal or any other container or body to which the material is to be dispensed. With such a dispensing system, the resilience of the stopper material seals the hole created by insertion of the needle through the stopper to thereby maintain the contents of the container in a sterile condition. However, by using a needle and syringe dispensing system in conjunction with a resilient container stopper, it is difficult to extract all the contents of the container and, therefore, it is common for some proportion of the container contents to be discarded and wasted. When the container contents comprise a relatively expensive pharmaceutical, veterinary product, chemical reagent or the like, the cost associated with discarding a portion of the container contents may be considerable.

In many instances, substances must be dispensed using a delivery system which does not involve the use of a needle. Heretofore, however, it has been common practice to use a needle to extract the substance from a container and to then discard the needle, or remove the needle from the syringe body and thereafter use the syringe, without the needle, to dispense the product. However, the handling of syringe needles inevitably gives rise to risks associated with accidental needle stick or inadequate or improper or unsafe disposal of the discarded needle. Accordingly, the use of a needle to facilitate extraction of the contents of a container when the needle is not to be used to dispense those contents is undesirable and, potentially, inefficient.

It is therefore desirable to provide a dispensing system which alleviates at least some of the disadvantages of existing dispensing systems.

It is also desirable to provide a dispensing system including a closure for a container that facilitates extraction of a fluid from the container in a manner that minimises risk of contents contamination.

It is also desirable to provide a dispensing system that may be used without the use of a needle to extract contents of a container.

It is also desirable to provide a dispensing system which minimises the risk of contamination of the contents of a container.

It is also desirable to provide a closure for containers storing a fluid whereby the fluid content is able to be removed by more than one extraction method a manner to minimise contamination of remaining contents.

It is also desirable to provide a closure for a container, particularly a container of a sterile liquid, which is economic to manufacture, is simple to use and facilitates dispensing of the container contents.

STATEMENTS OF THE INVENTION

According to one aspect of the invention there is provided a closure for a container adapted to store fluid to be dispensed, said closure comprising a body having an outer surface communicating with the exterior of said container and an inner surface embedded within said body wherein said outer surface includes a cavity adapted to sealably receive a dispensing device.

Preferably, the cavity, which extends into a body of the closure, is of a cylindrical shape, the bottom end of which is spaced from the inner surface.

In one form of the invention, a duct extends between the bottom surface of the cavity and the lower surface of the closure. Preferably, the duct is maintained in a closed condition, but is able to be opened to facilitate transfer of fluid from one end of the duct to the other either by the use of a dispensing device that is designed to pass into the duct, or on application of a fluid pressure differential to opposite ends of the duct.

The cavity end of the duct may be closed by a protective, sealing membrane or web. The membrane or web may comprise material of the closure, or be a separate membrane or web secured to the bottom surface of the cavity. Preferably, the membrane or web seals the duct against ingress of potentially contaminating material. An opening may be formed in the membrane by a dispensing device that is designed to pass into the duct, or to permit fluid to pass through the duct on application of a differential pressure. Thus, in the latter case, fluid pressure applied to the membrane on one side thereof may cause the membrane to rupture or perforate to allow the fluid to pass therethrough.

The closure may also be formed with a blind hole extending outwardly from the inner surface thereof. With this arrangement, both the blind hole and the cavity are spaced from the central axis of the closure which, in the preferred embodiment, is of circular configuration to fit a circular opening or neck of the container. Other shapes may be designed as required. Preferably, the outer surface of the closure has an indentation or other formation or mark which indicates the axis of the blind hole whereby the axis comprises an optimum needle entry point if it is necessary to insert a needle through the closure to extract fluid from the container. Alternatively, a normally-closed hole may be formed through the closure wall, the hole being adapted to receive and guide a needle, or being able to allow gas or air to pass through the closure in the event of a differential pressure occurring across the closure due, for example, to extraction of liquid from the container, or a build up of pressure within the container. A removable cover may be associated with such a normally-closed hole to enable selective access to the normally-closed hole.

In preferred embodiments, the cavity in the outer surface of the closure is of substantially cylindrical shape and is dimensioned to receive a substantially cylindrical or tapered boss on the end of a syringe adapted to withdraw fluid from the container.

Preferably, the shape of the boss corresponds substantially to the cavity so that walls of the cavity closely engage the outer surface of the boss. In one form, one or both of the cooperating surfaces is/are formed with ribs or other formations, or barbs or the like to assist inter engagement of the boss within the cavity and to assist in maintaining the boss in the engaged position to minimise the possibility of accidental removal of the boss from the cavity during withdrawal of fluid from the container.

According to another aspect of the invention there is provided a closure for a container adapted to store fluid to be dispensed, said closure comprising a body having an outer surface communicating with the exterior of said container and a lower surface in communication with the interior of said container and a duct traversing said outer and lower surfaces wherein said outer surface includes a receptor adapted to receive the boss of a dispensing device. With this arrangement, the receptor need not include a cavity.

According to another aspect of the invention there is provided a dispensing system for dispensing fluid stored in a container, said system including a closure for said container, said closure comprising a resilient body having an outer surface communicating with the exterior of said container and an inner surface embedded within said body wherein said outer surface includes a cavity, a duct extending from said cavity to said inner surface and a dispensing device wherein said dispensing device includes a hollow boss adapted to sealably engage with said cavity.

In preferred embodiments, the boss has a portion that passes through the duct so that the dispensing device communicates directly with the interior of the container. When the boss is withdrawn, the duct closes to again seal the container interior. The hollow opening through the boss may be of a size that relatively viscous liquids may be easily withdrawn from the container.

In one form, the dispensing device is in the form of a syringe barrel having a plunger to create the pressure differential. Preferably, after extraction of fluid from the container using the syringe, the syringe is withdrawn from the container closure and is then used to dispense the fluid either directly through the syringe outlet or through a needle attached thereto. A syringe for use with embodiments of the invention may be of any size commensurate with the container contents and the intended use thereof. Small, precise measurements of small quantities of fluid may be made with a small syringe while large amounts of fluid may be extracted and quickly and easily dispensed using a large syringe.

It will be appreciated that the invention is also applicable to adding fluid to a container using the closure of the invention and the dispensing system. In this aspect, the syringe which holds the fluid to be transferred to the container is engaged with the closure by engaging the boss on the syringe with the closure cavity. Actuation of the syringe plunger to pressurise the fluid in the syringe causes the fluid to pass therefrom through the duct and into the container.

The duct may be closed by a membrane at the bottom of the cavity, which membrane is able to be punctured by the fluid expressed from the syringe boss.

The duct is maintained in a closed condition by the resilience of the material from which the closure is made. Preferably, the closure is formed of a rubber or synthetic rubber, a synthetic plastics material or other like resilient material known in the art. When the closure is engaged within the opening of a container, the outer surface thereof, which is preferably cylindrical or substantially cylindrical, is an interference fit in the container opening such that the material of the closure is compressed thereby assisting the closing of the duct.

DETAILED DESCRIPTION OF THE INVENTION

In order that the invention is more readily understood, embodiments thereof will now be described with reference to the accompanying figures and legend:

| Legend |
|---|
| 12. Closure |
| 14. Container |
| 15. Neck |
| 16. Fluid |
| 17. Body |
| 18. Head |
| 19. Surface |
| 21. Opening |
| 22. Lower surface |
| 23. Outer surface |
| 24. Indentation |
| 26. Recess/Cavity |
| 27. Inner surface |
| 28. Duct |
| 29. Sealing membrane |
| 31. Boss |
| 32. Syringe |
| 33. Outer part |
| 34. Inner part |
| 36. Shoulder |
| 37. Channel |
| 38. Plunger |
| 39. Tamper ring |
| 41. First blind opening |
| 42. Second blind opening |
| 43. Membrane |
| 44. Conical boss |
| 46. Barrel |
| 47. Slit or hole in membrane |
| 51. Web |
| 52. Barbs |
| 55. Opening |
| 56. Bridging cap |
| 57. Sealing top |
| 58. Threads |
| 59. Disc |

Figure 1:
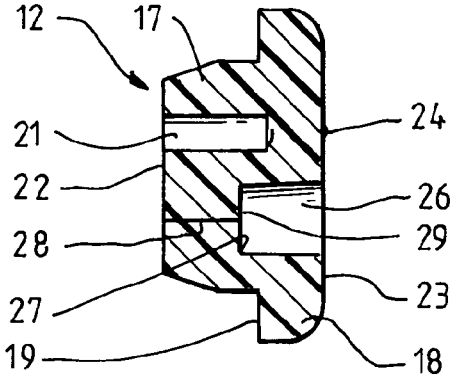
FIG. 1 is a cross sectional, elevational view of a closure in accordance with one embodiment of the invention.
Figure 2:
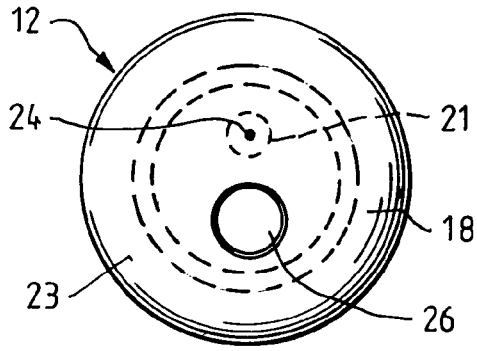
FIG. 2 is an end elevational view of the closure of FIG. 1.
Figure 4:
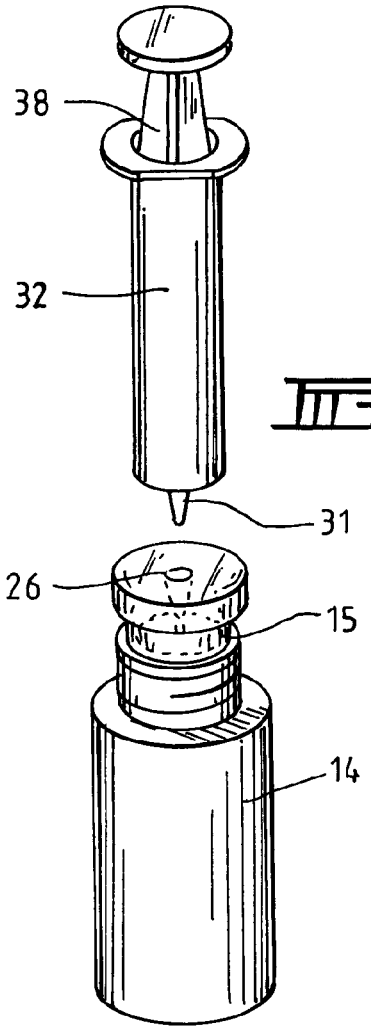
FIG. 4 is a perspective view of a second embodiment of the invention.
Figures 3, 10, 11, 12:
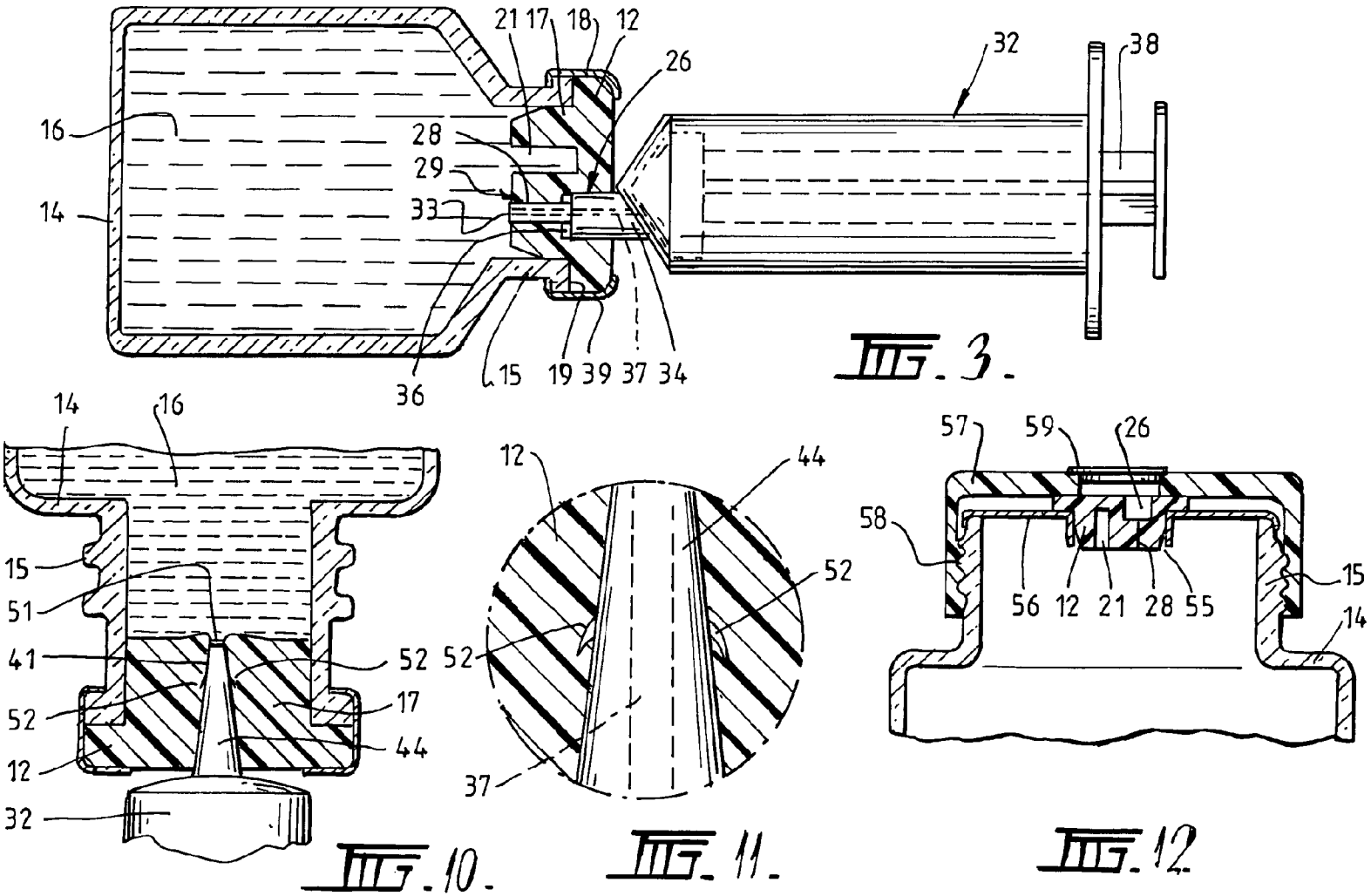
FIG. 3 is a cross sectional view of the closure of FIG. 1 secured to a vial and having a syringe engaged therewith.
FIG. 10 is a modified form of the embodiment illustrated in FIG. 6.
FIG. 11 is an enlarged view of FIG. 10.
FIG. 12 is a cross-sectional view of a further embodiment of the invention.

Referring to the drawings, FIGS. 1 to 3 illustrate one form of closure in accordance with an embodiment of the invention, the closure 12 being adapted to engage within an opening of a container 14, such as an vial. The vial may be used for storing a sterile liquid, such as a pharmaceutical or veterinary product, or a food supplement or any other fluid 16 which is to be dispensed from the container 14.

The closure 12 is formed of a resilient material such as rubber, synthetic rubber, synthetic plastics material or any other suitable material that will be known in the art. The closure has a substantially cylindrical body 17 with an enlarged head 18 defining an annular surface 19 adapted to engage a corresponding surface of the container 14.

The body 17 has a substantially cylindrical opening 21 extending from a lower surface 22 opposite the head 18. The opening 21 extends in the axial direction of the closure 12 and terminates a short distance from the outermost surface 23 of the head 18. At about the point where the axis of the opening 21 meets the outer surface 23, a mark, or indentation 24 is formed in the outer surface 23 thereby marking the opening axis. The indentation 24 may be used as a guide to insert a needle through that portion of the head 18 leading to the opening 21 whereby a syringe needle is able to be used to pass through the material of the closure 12 into the container 14 to thereby facilitate extraction of fluid 16 from the container 14 by the syringe.

On removal of a syringe needle from its engagement through the head 18 of the closure 12, the resilience of the material of the closure ensures that the hole formed by a passage of the needle is sealed.

A syringe needle or the like may also be used as a vent to enable air or gas to pass into or out of the container 14, when contents are being withdrawn or introduced into the container, as hereinafter described.

The outer surface 23 of the closure 12 is formed with a recess or cavity 26 which, in this embodiment, is of substantially cylindrical shape. The cavity passes into the body 17 and terminates at an inner surface 27. A duct 28 extends from the inner surface 27 to the lower surface 22 of the body 17 of the closure 12. The duct 28 is maintained in a closed condition by the resilience of the material of the closure 12 together with compressive forces generated when the closure 12 is engaged within the neck 15 of the container 14.

A sealing membrane 29 seals the duct 28 at the inner surface 27 of the cavity 26. The sealing membrane 29 may comprise material of the closure 12 or may comprise a separate protective membrane 29 secured by adhesive or the like to the inner surface 27 of the cavity 26. In a modification, the membrane 29 may be provided with a very small hole or a valve through which the container may vent any excess gas pressure that may otherwise build up in the container.

In use, as shown particularly in FIG. 3, the cavity 26 is adapted to receive a cylindrical boss 31 extending from the end of a syringe 32. The boss 31 is formed of two parts comprising an outer part 33 and an inner part 34 having a larger diameter than the outer part 33 thereby forming a shoulder 36.

As particularly shown in FIG. 3, in use, the boss 31 is engaged within the cavity 26, the engagement pressure being such that the outer part 33 pierces the sealing membrane 29 and expands the duct 28 so that the outer part 33 engages within the duct 28. The inner part 34 of the boss 31 is closely received within the cavity 26, the shoulder 36 restricting the engagement movement of the boss 31. In the engaged position, as shown in FIG. 3, a channel 37 formed through the boss 31 and communicating with the interior of the syringe 32 enables the fluid 16 to be withdrawn from the container 14 on movement of the syringe plunger 38.

When sufficient fluid 16 has been withdrawn from the container 14, the boss 31 is withdrawn from the duct 28 and cavity 26. The duct 28 reseals due to the resiliency of the material of the closure and the compressive forces applied, as aforesaid, when the closure is engaged with the container neck 15.

Removal of the syringe 32 from its engagement with the closure 12, the syringe may be used to express the fluid therein in a manner to dispense the fluid as required. Such fluid dispensing may be by way of discharging the syringe into the mouth or other orifice of an animal, human or the like for oral or other administration of the fluid. Alternatively, the fluid may be delivered as a drench, or inserted into ear cavities, or used as an eye dropper or for any other appropriate purpose. The embodiment described facilitates removal and dispensing of fluid from a fluid container without the need to use a needle as heretofore required. However, the described embodiment facilitates the use of a needle, if required, to extract fluid from or deliver fluid to the container 14. It will be appreciated that the opening 21, which is provided for the purpose of reducing the thickness of material of the closure, through which a needle would otherwise need to penetrate, may be formed of any appropriate cross sectional shape, and will be of a length sufficient to ensure that, when a needle is used to penetrate the head 18 into the opening 21, withdrawal of the needle results in the hole formed thereby completely sealing to prevent contamination of the fluid 16 in the container.

The closure 12 is preferably held to the container 14 by a spun metal ring or a plastic, tamper evident sealing ring 39 which has the dual function of ensuring that the closure 12 remains properly sealed to the container 14 as well as providing a tamper evident seal well known in the art.

Referring to FIGS. 4 to 7, a container 14 is fitted with a closure 12 in a similar manner to that shown in FIGS. 1 to 3. In this embodiment, the closure, more particularly seen in FIG. 6, has a substantially centrally located, truncated, conical, blind opening 41 extending from the outer surface 23 of the closure 12. The end of the blind opening 41 is spaced from the end of a second blind opening 42 extending outwardly from the lower surface 22 by a membrane 43 formed, in this embodiment, by material of the closure 12. In the illustrated embodiment, the second blind opening 42 is substantially cylindrical and substantially coaxial with the truncated, conical, blind opening 41.

In use of this embodiment, a syringe 32 has a coaxially extending, substantially truncated conical boss 44 extending from the closed end of the syringe barrel 46. A channel 37 communicates through the conical boss 44 with the interior of the syringe 32.

Figure 5:
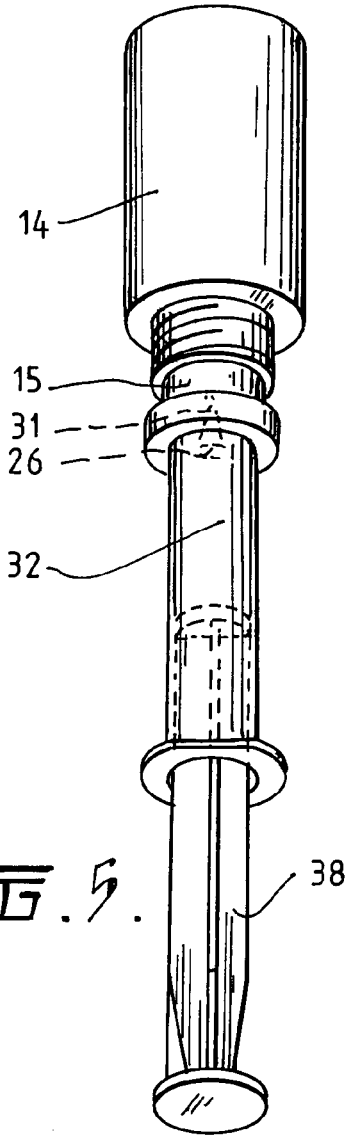
FIG. 5 is a view similar to that of FIG. 4 illustrating the syringe in use in combination with the closure of this embodiment.
Figure 6:
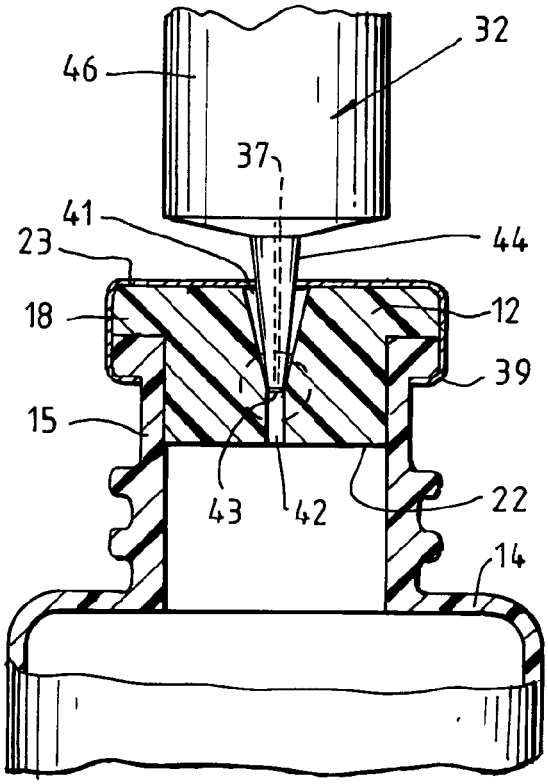
FIG. 6 is a partial cross sectional view of the syringe, closure and container of FIG. 5.
Figure 7:
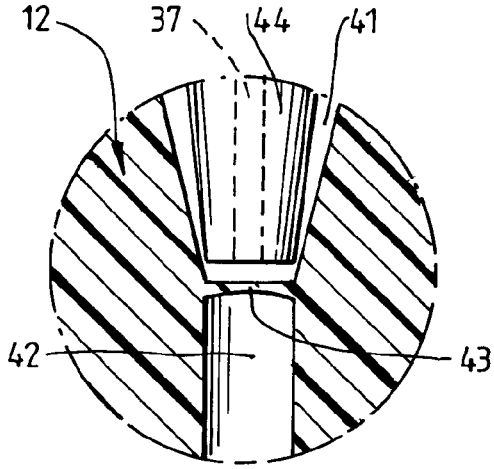
FIG. 7 is an enlargement of FIG. 6 showing the engagement of the syringe with the closure.

In use, the conical boss 44 of the syringe 32 is engaged within the blind opening 41, as particularly shown in FIG. 6. The container 14 and engaged syringe 32 is inverted, as shown in FIG. 5, and the end of the conical boss 44 is then pushed through the membrane 43 so that the channel 37 communicates with fluid 16 in the container 14. The syringe plunger 38 is retracted to draw fluid from the container 14 into the syringe through the second blind opening 42 and into the channel 37 and syringe barrel 46.

When sufficient fluid has been withdrawn, as may be indicated by graduation marks on this side of the syringe barrel 46, the conical boss 44 is withdrawn from the blind opening 41. The perforated membrane 43 is preferably of such a thickness and resiliency as to close the formed opening between the blind opening 41 and second blind opening 42.

Figure 8:
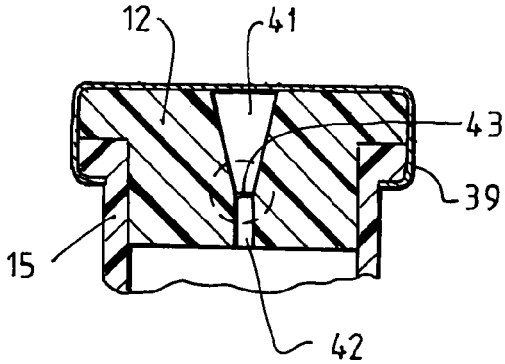
FIG. 8 is a partial cross sectional view similar to that of FIG. 6 but showing a further embodiment of the invention.
Figure 9:
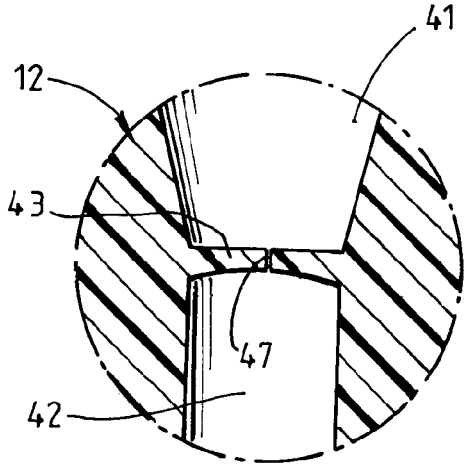
FIG. 9 is an enlargement of the engaging syringe with the closure.

In a modified form of this embodiment, as shown in FIGS. 8 and 9, the membrane 43 is formed with a slit or hole 47 to facilitate the entry of the conical boss 44 through the membrane 43 and into the second blind opening 42.

It will be appreciated that the fluid withdrawn into the syringe barrel 46 may be dispensed therefrom in any suitable manner and for any typical purpose.

Although the conical boss 44 and conical blind opening 41 are shown in the drawings as having different wall angles relative to the respective axis, in other preferred embodiments, the cone angles of each may be the same.

The surface of the conical boss 44 and/or the blind opening 41 may be formed with ribs, serrations or other formations to assist retention of the conical boss 44 within the blind opening 41 to minimise accidental disconnection of the conical boss from the blind opening 41.

In a modified form of closure 12, as shown in FIGS. 10 and 11, the blind opening 41 extends substantially through the body 17 of the closure 12, the opening 41 being closed at the inner end by a web, membrane or the like 51. In this embodiment, the conical boss 44 on the end of the syringe barrel 46 is able to puncture the web 51 to place the interior of the barrel 46 in fluid communication with the interior of the container 14.

In this embodiment, the conical boss 44 is provided with one or more rearwardly extending barbs 52 which engage with the wall of the blind opening 41 and assist in retaining the conical boss 44 in engagement therewith.

Referring to FIG. 12, a modified form of the invention is shown in which a closure 12 is adapted to be received within an opening 55 in a bridging cap 56 adapted to engage with the neck 15 of a container 14. The neck 15 of the container 14 may be of any size, and a bridging cap 56 is made of a size to suit. Thus, the closure 12 can be adapted to fit to any size and form of container 14. A sealing top 57 engaged on the neck 15 by screw threads 58, or any other securing structure, holds the closure 12 firmly and sealingly to the bridging cap 56. Tamper evident securing means may be use in conjunction with the sealing top 57 to ensure that it is not removed. Reinforcing ribs or the like may be provided to provide the necessary structural strength to the bridging cap 56 and the sealing top 57.

The sealing top 57 is preferably formed with a tamper evident membrane or breather disc 59 or the like the removal of which gives access to the closure and recess 26. Vent openings (not shown) may be provided to allow any build up of excess gas pressure within the container 14 to escape thereby reducing any likelihood of the container 14 bursting.

The use of bridging caps 56 on different diameters enables one size of closure to be used on a plurality of different sizes of container necks 15. This allows large containers to be quickly filled with a liquid to be dispensed and yet facilitates dispensing very small quantities of the liquid. The bridging cap 56 may take many different forms.

It will be appreciated that the dispensing system of the invention may be used to dispense fluids of most forms, including relatively viscous creams, gels, liquids and gases, provided the fluid is able to flow from the container to the syringe or other dispensing device.

It will also be appreciated that while the preferred dispensing device is a syringe like dispenser, other forms of dispensing device may be used with the present invention including pipettes, expandable containers and other like devices.

Although embodiments of the invention have been described in relation to withdrawal of fluid from a container, the features of the invention are equally applicable to devices for inserting fluids into containers.

Many modifications may be made in the design and/or construction of a dispensing system in accordance with the invention and all such modifications that come within the scope of the invention shall be deemed to be within the ambit of the above description.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

The invention claimed is:

1. A closure for a container for storing a fluid to be dispensed from the container through the closure, the container being provided with an opening, the closure comprising:

a body having an outer surface for location outwardly of the opening of the container, and an inner surface for location within the container, the outer surface being provided with a cavity for sealingly receiving a part of a dispensing device therein, said cavity extending partially from the outer surface through the body so as to have an end wall located within the body;

the inner surface of the body being provided with a duct extending from the inner surface of the body towards the end wall of the cavity;

a membrane being located intermediate the end wall of the cavity and the duct, said membrane being made from the same material as the closure and formed at the end wall of the cavity to provide a seal intermediate the end wall of the cavity and the end of the duct so as to seal the closure;

said duct being maintained in a normally closed condition preventing movement of fluid from the container therethrough;

wherein the cavity and the duct are arranged coaxially with each other such that when the part of the dispensing device is received in the cavity, the part of the dispensing device pierces or penetrates the membrane to open the duct allowing fluid communication between the duct and the part of the dispensing device in the cavity permitting fluid to be withdrawn from the container through the duct into the dispensing device when located within the cavity; and when the part of the dispensing device is removed from the duct, the duct and membrane close to reseal the container by preventing fluid communication between the duct and the cavity.

2. A closure according to claim 1, in which the end wall of the cavity and the membrane form the seal between the cavity and the duct for sealing the closure by separating the cavity from the duct when the closure is in a sealed condition so as to prevent contents of the container from entering the cavity.

3. A closure according to claim 1, in which the cavity is of a cylindrical or conical shape and is adapted to receive the part of the dispensing device in the form of a corresponding cylindrical or conical boss.

4. A closure according to claim 1, in which the duct is openable by application of differential fluid pressure on either side of the duct or by physical insertion of an end of the dispensing device into the duct so as to piece or penetrate the membrane and to open the duct.

5. A closure according to claim 1, in which the end wall of the cavity is the membrane and the membrane is of a thickness and resiliency so as to close the duct from the cavity.

6. A closure according to claim 1, wherein the membrane is formed as an integral extension of the end wall of the cavity.

7. A closure according to claim 1, in which the end wall of the cavity is provided with a separate protective membrane secured to the end wall of the cavity.

8. A closure according to claim 1, in which the duct further includes an opening provided on the inner surface of the body, wherein the opening of the duct is resealable.

9. A closure according to claim 8, in which the opening of the duct is a blind hole or blind bore extending inwardly through the body of the closure from the inner surface thereof in a direction towards the outer surface to terminate part way through the body at the membrane or end wall of the cavity.

10. A closure according to claim 9, wherein the blind hole or blind bore and the cavity are both spaced from the central axis of the body and are each spaced apart from one another.

11. A closure according to claim 9, wherein the outer surface of the body is provided with a visual or physical indication of the axis of the opening or blind hole or blind bore.

12. A closure according to claim 1, in which the seal at the end wall of the cavity and the membrane are pierced or penetrated by insertion of the part of the dispensing device into the cavity and when the part of the dispensing device is removed from the cavity, the duct closes to reseal the container.

13. A closure according to claim 12, in which the dispensing device is in the form of a syringe having a boss or stub and the cavity is arranged to receive the boss or stub of the syringe.

14. A closure according to claim 12, in which the duct is plastically deformable to an open position from the normally closed position.

15. A closure according to claim 1, in which the cavity is provided with tapering sides for receiving corresponding tapering sides of the part of the dispensing device.

16. A closure according to claim 1, in which the length of the cavity and duct corresponds to the length of the part of the dispensing device received in the cavity so that when the part of the dispensing device is received in the cavity, an end of the part of the dispensing device is aligned with the opening of the duct in the inner surface of the closure.

17. A closure according to claim 1, in which the closure including the membrane is made from a resilient material that is resiliently deformable so that the duct is self sealing at the normal at-rest position.

* * * * *